US006446965B1

(12) United States Patent
Boulton

(10) Patent No.: US 6,446,965 B1
(45) Date of Patent: Sep. 10, 2002

(54) GAMING MACHINES

(75) Inventor: Anthony Boulton, Tadworth (GB)

(73) Assignee: Project Leisure Limited, London (GB)

( * ) Notice: Subject to any disclaimer, the term of this patent is extended or adjusted under 35 U.S.C. 154(b) by 0 days.

(21) Appl. No.: 09/688,009

(22) Filed: Oct. 13, 2000

(30) Foreign Application Priority Data

Oct. 14, 1999 (GB) ..... 9924211

(51) Int. Cl.[7] ..... A63B 71/00

(52) U.S. Cl. ..... 273/142 R; 273/142 E; 273/142 G; 273/143 R; 463/7; 463/16; 463/20

(58) Field of Search ..... 273/142 R, 142 E, 273/142 G, 143 R

(56) References Cited

U.S. PATENT DOCUMENTS

| | | | | | |
|---|---|---|---|---|---|
| 4,095,794 | A | * | 6/1978 | Garto et al. | 273/101 |
| 4,357,015 | A | * | 11/1982 | Santora et al. | 273/142 E |
| 4,735,416 | A | | 4/1988 | McNally | |
| 5,393,057 | A | * | 2/1995 | Marnell, II | 273/85 CP |
| 5,639,089 | A | * | 6/1997 | Matsumoto et al. | 273/142 E |
| 5,785,594 | A | * | 7/1998 | Seibert, Jr. et al. | 463/17 |
| 5,848,932 | A | * | 12/1998 | Adams | 463/20 |
| 5,934,999 | A | * | 8/1999 | Valdez | 463/17 |
| 6,042,114 | A | * | 3/2000 | Phillip | 273/142 R |
| 6,047,963 | A | * | 4/2000 | Pierce et al. | 273/121 B |
| 6,047,965 | A | * | 4/2000 | Mollo et al. | 273/142 E |
| 6,050,895 | A | * | 4/2000 | Luciano, Jr. et al. | 463/7 |
| 6,139,013 | A | * | 10/2000 | Pierce et al. | 273/121 B |
| 6,173,955 | B1 | * | 1/2001 | Perrie et al. | 273/146 |
| 6,220,593 | B1 | * | 4/2001 | Pierce et al. | 273/138.1 |
| 6,267,669 | B1 | * | 7/2001 | Luciano, Jr. et al. | 463/7 |
| 6,270,409 | B1 | * | 8/2001 | Shuster | 463/20 |
| 6,286,833 | B1 | * | 9/2001 | Collins | 273/243 |
| 6,311,976 | B1 | * | 11/2001 | Yoseloff et al. | 273/138.2 |
| 6,315,660 | B1 | * | 11/2001 | DeMar et al. | 463/16 |
| 6,319,122 | B1 | * | 11/2001 | Packes, Jr. et al. | 463/16 |
| 6,334,814 | B1 | * | 1/2002 | Adams | 463/20 |

FOREIGN PATENT DOCUMENTS

| | | | | |
|---|---|---|---|---|
| GB | 2 218 558 A | * | 11/1989 | G07F/17/34 |
| GB | 2284499 | | 6/1995 | |
| JP | 06327807 A | * | 11/1994 | A63F/5/04 |
| WO | 99/11341 | | 3/1999 | |

OTHER PUBLICATIONS

Williams Electronics Games, Inc.—Jul. 1996—pp. III–IV.*
Williams Electronics Games, Inc.—Jul. 1996—pp. III–IV.*

* cited by examiner

*Primary Examiner*—Benjamin H. Layno
*Assistant Examiner*—Dolores Collins
(74) *Attorney, Agent, or Firm*—Smith-Hill & Bedell

(57) ABSTRACT

Gaming machines (10) comprising a first game (12) which may be of a generally conventional reel-based type and playable by a user upon activation, and a second game (14) playable upon activation following successful play of the first game (12), the second game (14) comprising a roulette-type component (16). In an alternative embodiment the first game (12) may comprise the roulette-type component (16).

19 Claims, 1 Drawing Sheet

GAMING MACHINES

The present invention relates to gaming machines.

Gaming machines come in various types and are generally operable upon insertion of appropriate credit , such as money or token. However, in this specification machines that do not require credit also fall within the term gaming machines.

According to the present invention there is provided a gaming machine comprising a first game playable by a user upon activation and a second game playable upon activation following play of the first game, one of the first and second games comprising a roulette-type component.

The roulette-type component may comprise a wheel which wheel may be of conventional or generally conventional roulette wheel design. The game may comprise a conventional or substantially conventional game of roulette. The roulette game may be electronically simulated in part or in whole, for example by video or other means and may be controlled by control means in the machine. The roulette-type component may be the same or similar to that disclosed in U.K. Patent Application No. 9284499 or International Patent Application No. PCT/GB98/02599. The wheel may be inaccessible directly by a user of the machine, for example the wheel may be located behind a transparent protective screen. Alternatively, the wheel or a part thereof may be accessible for physical rotation by a user.

Preferably the roulette-type component provides for win facilities, which may award a winning user by controlling the dispensing of one more coins, tokens and/or credits thereto. The win facilities may comprise areas defined an the wheel and may further comprise sensing means to detect location of the area(s) relative to for example a ball whereby to enable determination of a win.

Preferably the second game comprises the roulette-type component. The first game may comprise a generally conventional reels-based game. Alternatively, the first game may comprise a reels-based game in which the reels are electronically simulated in part or in whole, for example by video or other means and may be controlled by control means in the machine. The control means may be the aforementioned control means or further control means. Preferably the first game is operable to activate the roulette-type component for play by a user of the machine upon successful play of the first game by a user. Alternatively, the roulette-type component may be comprised in the first game.

Preferably means is provided to enable switching between play of the first and second games, which switching may be effected, perhaps selectively, by a user.

Figure 1:
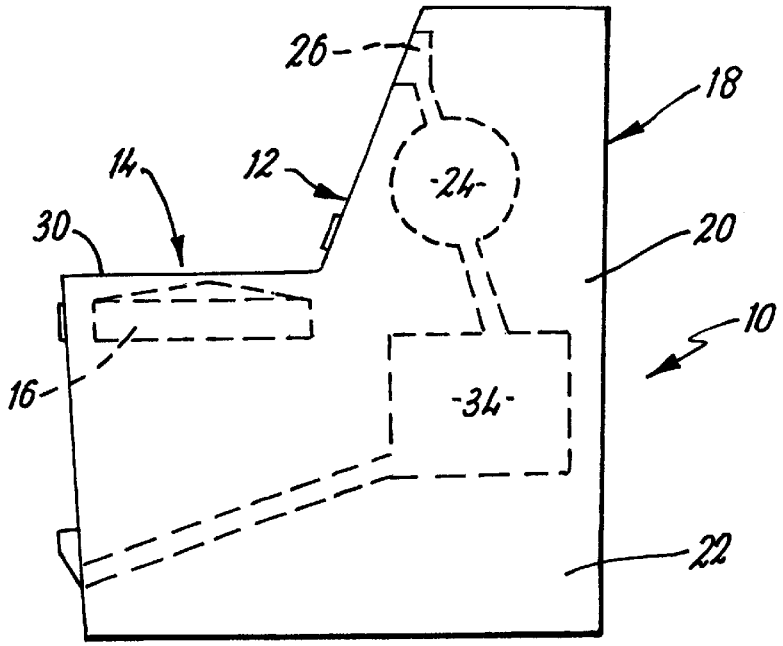
Figure 2:
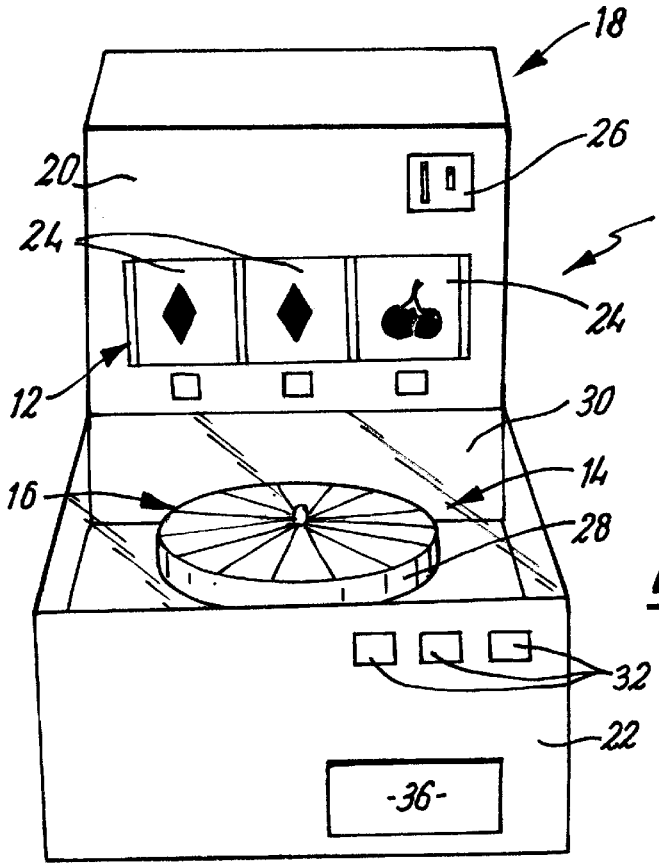

An embodiment of the present invention will now be described by way of example only, with reference to accompany drawings in which:

FIG. 1 is a diagrammatic side view of a gaming machine according to the present invention; and FIG. 2 is a perspective front view of the machine of FIG. 1.

Referring to the drawings there is provided a gaming machine 10 comprising a first game 12 playable by a user upon activation and second game 14 playable upon activation following successful play of the first game 12, the second game 14 comprising a roulette-type component 16. In an alternative embodiment, the first game 12 may comprise a roulette-type component.

In more detail, the machine 10 comprises an outer casing 18 with an upper portion 20 in which is generally located the first game 12 and a lower portion 22 in which is located the second game 14.

The first game 12 comprises a substantially conventional reels-based game comprising three reels 24 controlled by a substantially conventional control means (not shown) and activated upon insertion of appropriate credits into the machine through the credit slot 26 provided on the casing 18. It will be appreciated that the reels of the reels-based game can alternatively be electronically simulated in part of in whole, for example by video simulation The video simulation can be controlled by control means. The first game 12 is operable to effect either directly or indirectly activation of the second game 14, preferably upon a user achieving a win or otherwise achieving a successful play of the first game 12.

The second game comprises the roulette-type component 16 which is shown in the drawings as a tangible wheel 28 of substantially conventional roulette wheel design. It will be appreciated however that the wheel 28 does not necessarily have to be of conventional roulette design, and moreover could be intangible or at least partly so, for example could be a visual simulation of a wheel, such as a video simulation.

The second game 14 comprises control means associated with the wheel 28 which provides for the second game 14 comprising a conventional or substantially conventional game of roulette when activated. The wheel 28 is shown encased behind a clear protective screen 30 such that selection of desired segments on or the control of the wheel 28 by a user are done remotely via control buttons 32.

Alternatively. the wheel 28 may be accessible for manual rotation and whereby rotation may be manual directly on the wheel 28.

In use, a user inserts credit into the machine 10 through the credit slot 26. If sufficient credit is inserted, the first game is activated for play. If the player is successful with the first game, which success may comprise achieving a win or partial win line or locating an appropriate symbol on the win line, the second game 14 is activated. The user can then play a substantially conventional game of roulette by selecting the desired segments on the wheel 28 either electronically or physically followed by actuation of the wheel 28 again either electronically or manually to determine whether the user achieves a win or not. If the user is successful in achieving a win on the second game, then the machine dispenses an appropriate win which may be credits, tokens or coins from a store 34 within the casing 18 into a winnings trough 36.

It will be appreciated that according to a further embodiment the roulette-type component could be comprised in the first game 12 and the reels-based game or any other alternative game provided as the second game 14. Indeed, the reels-based game could be replaced by any suitable game for play in conjunction with the roulette-type component.

It will further be appreciated that a control means may be provided to enable the first game 12 to be played following play of the second game 14 and means may be provided to enable selective activation of the first 12 and/or second games 14 by a user.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

What is claimed is:

1. A gaming machine comprising a first game playable by a user upon activation and a second game playable upon activation following play of the first game, one of the first and second games comprising a roulette-type component comprising a wheel having a plurality of areas and a ball receivable in one of the areas on each play of the roulette-type component.

2. A gaming machine as claimed in claim 1, in which the wheel is of conventional or generally conventional roulette wheel design.

3. A gaming machine as claimed in claim 1, in which the game comprises a conventional or substantially conventional game of roulette.

4. A gaming machine as claimed in claim 1, in which the game is electronically simulated in part or in whole, for example by video or other means.

5. A gaming machine as claimed in claim 1, in which the game is controlled by control means in the machine.

6. A gaming machine as claimed in claim 1, in which the wheel is inaccessible directly by a user of the machine, for example the wheel may be located behind a transparent protective screen.

7. A gaming machine as claimed in claim 1, in which the wheel or a part thereof is accessible for physical rotation by a user.

8. A gaming machine as claimed in claim 1, in which the roulette-type component provides for win facilities.

9. A gaming machine as claimed in claim 8, in which the component awards a winning user by controlling the dispensing of one more coins, tokens and/or credits thereto.

10. A gaming machine as claimed in claim 8, in which the win facilities comprise areas defined on the wheel.

11. A gaming machine as claimed in claim 8, in which the win facilities comprise sensing means to detect location of the area(s) relative to the ball whereby to enable determination of a win.

12. A gaming machine as claimed in claim 1, in which the second game comprises the roulette-type component.

13. A gaming machine as claimed in claim 1, in which the first game comprises a generally conventional reels-based game.

14. A gaming machine as claimed in claim 1, wherein the first game comprises a reels-based game in which the reels are electronically simulated in part or in whole, for example by video or other means.

15. A gaming machine as claimed in claim 14, in which the game is controlled by control means in the machine.

16. A gaming machine as claimed in claim 12, in which the first game is operable to activate the roulette-type component for play by a user of the machine upon successful play of the first game by a user.

17. A gaming machine as claimed in claim 1, in which the roulette-type component is comprised in the first game.

18. A gaming machine as claimed in claim 1, in which means is provided to enable switching between play of the first and second games.

19. A gaming machine as claimed in claim 18, in which switching is effected, perhaps selectively, by a user.

* * * * *